US007950248B2

(12) United States Patent
Cho

(10) Patent No.: US 7,950,248 B2
(45) Date of Patent: May 31, 2011

(54) REFRIGERATOR HAVING COMPONENT AND STORAGE COMPARTMENTS

(75) Inventor: Kyu-su Cho, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 415 days.

(21) Appl. No.: 12/153,376

(22) Filed: May 16, 2008

(65) Prior Publication Data

US 2009/0071185 A1 Mar. 19, 2009

(30) Foreign Application Priority Data

Sep. 14, 2007 (KR) ..... 10-2007-0093801
Dec. 13, 2007 (KR) ..... 10-2007-0129860

(51) Int. Cl.
*F25D 11/02* (2006.01)

(52) U.S. Cl. ..... 62/441; 62/446

(58) Field of Classification Search ..... 62/441, 62/431, 443, 446, 454, 419, 498; 312/409, 312/407

See application file for complete search history.

(56) References Cited

U.S. PATENT DOCUMENTS 3,984,223 A * 10/1976 Whistler, Jr. ..... 62/81
3,992,171 A * 11/1976 Jenewein ..... 62/419
4,509,339 A * 4/1985 Mehlan et al. ..... 62/450
5,729,997 A * 3/1998 Witsoe ..... 62/407
7,549,300 B2 * 6/2009 Chun et al. ..... 62/419
2002/0069659 A1 * 6/2002 Lee ..... 62/234

* cited by examiner

*Primary Examiner* — Mohammad Ali
(74) *Attorney, Agent, or Firm* — Staas & Halsey LLP

(57) ABSTRACT

A refrigerator includes a main body cabinet which includes an external cabinet, and an internal cabinet disposed inside the external cabinet and including a partition wall forming first and second storage compartments partitioned right and left, one of the first and second storage compartments being provided thereunder with a component compartment accommodating a compressor between the external cabinet and the internal cabinet but the other one being not provided thereunder with the component compartment; a bottom cabinet which is coupled to a bottom of the main body cabinet and accommodates a condenser for condensing a refrigerant received from the compressor accommodated in the component compartment. Thus, the capacity of the storage compartment increases, so that the inner space of the storage compartment can be efficiently used.

12 Claims, 7 Drawing Sheets

REFRIGERATOR HAVING COMPONENT AND STORAGE COMPARTMENTS

CROSS-REFERENCE TO RELATED APPLICATIONS

This application claims priority from Korean Patent Application No. 10-2007-0093801, filed on Sep. 14, 2007 and Korean Patent Application No. 10-2007-0129860, filed on Dec. 13, 2007 in the Korean Intellectual Property Office, the disclosure of which is incorporated herein by reference in its entirety.

BACKGROUND

1. Field

The present invention relates to a refrigerator, and more particularly, to a refrigerator having a decreased capacity of a component compartment and an increased capacity of a storage compartment.

2. Description of the Related Art

In general, a refrigerator is provided with a cooling cycle which is represented by a compressor compressing a gaseous refrigerant of a low temperature and a low pressure to a gaseous refrigerant of a high temperature and a high pressure, a condenser condensing the gaseous refrigerant of the high temperature and the high pressure supplied from the compressor to be a liquid refrigerant, a capillary tube decompressing the refrigerant supplied from the condenser, and an evaporator evaporating the refrigerant passing through the capillary tube to have a low temperature under a lower pressure, thereby absorbing heat inside a compartment.

As an increasing number of consumers prefer a large-capacity storage compartment, a side-by-side refrigerator has recently spread in which a freezer compartment and a refrigerator compartment are disposed at left and right sides in consideration of capacity and storability for a stored items.

FIG. 7 illustrates a rear perspective view of a conventional refrigerator. As shown therein, the refrigerator includes a main body cabinet 103 shaped like a box having a frontward opening. The main body cabinet 103 is partitioned at right and left sides into a refrigerator compartment 107 and a freezer compartment 109. Further, a refrigerator compartment door 111 and a freezer compartment door 113 are provided in front of the refrigerator compartment 107 and the freezer compartment 109 to open and close the refrigerator compartment 107 and the freezer compartment 109, respectively.

A lower part of the refrigerator and freezer compartments 107 and 109 is provided with a partition to accommodate a compressor 121 and a condenser 123 to prevent a cooling performance of the evaporator that generates a cooling air from being deteriorated due to heat of a high temperature that is generated from the compressor 121 and the condenser 123. Conventionally, the partitioned area for the compressor 121 and the condenser 123 will be called a component compartment 115.

Since the temperature of the component compartment 115 increases to a high temperature due to the operations of the compressor 121 and the condenser 123, it is necessary to cool the compressor 121 and the condenser 123 by a fan 125 to circulate air around the compressor 121 and the condenser 123.

However, in the conventional refrigerator, the component compartment to accommodate the compressor, the condenser and the fan therein is placed throughout the lower part of the storage compartment divided into the refrigerator and freezer compartments, and thus partially occupies a capacity that may be assigned to the storage compartment of the main body cabinet. In other words, the component compartment decreases the capacity of the storage compartment, so that an inner space of the storage compartment is not efficiently used.

SUMMARY

Accordingly, it is an aspect of the present embodiment to provide a refrigerator of which a storage compartment has an increased capacity to thereby efficiently use an inner space thereof.

Additional aspects and/or advantages will be set forth in part in the description which follows and, in part, will be obvious from the description, or may be learned by practice of the present invention.

The foregoing and/or other aspects of the present invention can be achieved by providing a refrigerator including a main body cabinet which includes an external cabinet, and an internal cabinet disposed inside the external cabinet and including a partition wall forming first and second storage compartments partitioned right and left, one of the first and second storage compartments being provided thereunder with a component compartment accommodating a compressor between the external cabinet and the internal cabinet but the other one being not provided thereunder with the component compartment; a bottom cabinet which is coupled to a bottom of the main body cabinet and accommodates a condenser for condensing a refrigerant received from the compressor accommodated in the component compartment.

The condenser may be provided as an in-line type along a surface of the bottom cabinet.

The bottom cabinet may be formed with an air inlet through which external air is introduced to the condenser, and the main body cabinet may be formed with a communicating hole at a bottom thereof, through which air passed by the condenser is introduced into the component compartment.

The refrigerator may further include a ventilating channel provided in the main body cabinet communicating with the component compartment and guiding air in the component compartment to be discharged outwardly.

The refrigerator may further include a fan provided in either of the component compartment or the ventilating channel and blowing air in the component compartment outwardly.

The fan may face the compressor and be oblique to a longitudinal axis of the ventilating channel.

The bottom cabinet may be disposed under the component compartment.

Another aspect may be achieved by providing a refrigerator including an external cabinet; and an internal cabinet disposed inside the external cabinet and including a partition wall forming first and second storage compartments partitioned right and left, one of the first and second storage compartments being provided thereunder with a component compartment accommodating a compressor between the external cabinet and the internal cabinet but the other one being not provided thereunder with the component compartment.

The refrigerator may further include a ventilating channel formed between a bottom of the refrigerator and one of the partitions and communicating with the component compartment to guide air from the component compartment to an outside of the refrigerator.

The refrigerator may further include a bottom cabinet disposed under the external cabinet with the component compartment therebetween, and accommodating a condenser for condensing a refrigerant received from the compressor accommodated in the component compartment.

The condenser may be provided as an in-line type along a surface of the bottom cabinet.

The ventilating channel may be formed by the bottom of the refrigerator.

BRIEF DESCRIPTION OF THE DRAWINGS

These and/or other aspects will become apparent and more readily appreciated from the following description of the embodiment, taken in conjunction with the accompanying drawings, in which:

FIG. 4 is an exploded perspective view showing a part of the component compartment in

FIG. 3;

DETAILED DESCRIPTION OF THE EMBODIMENTS

Figure 1:
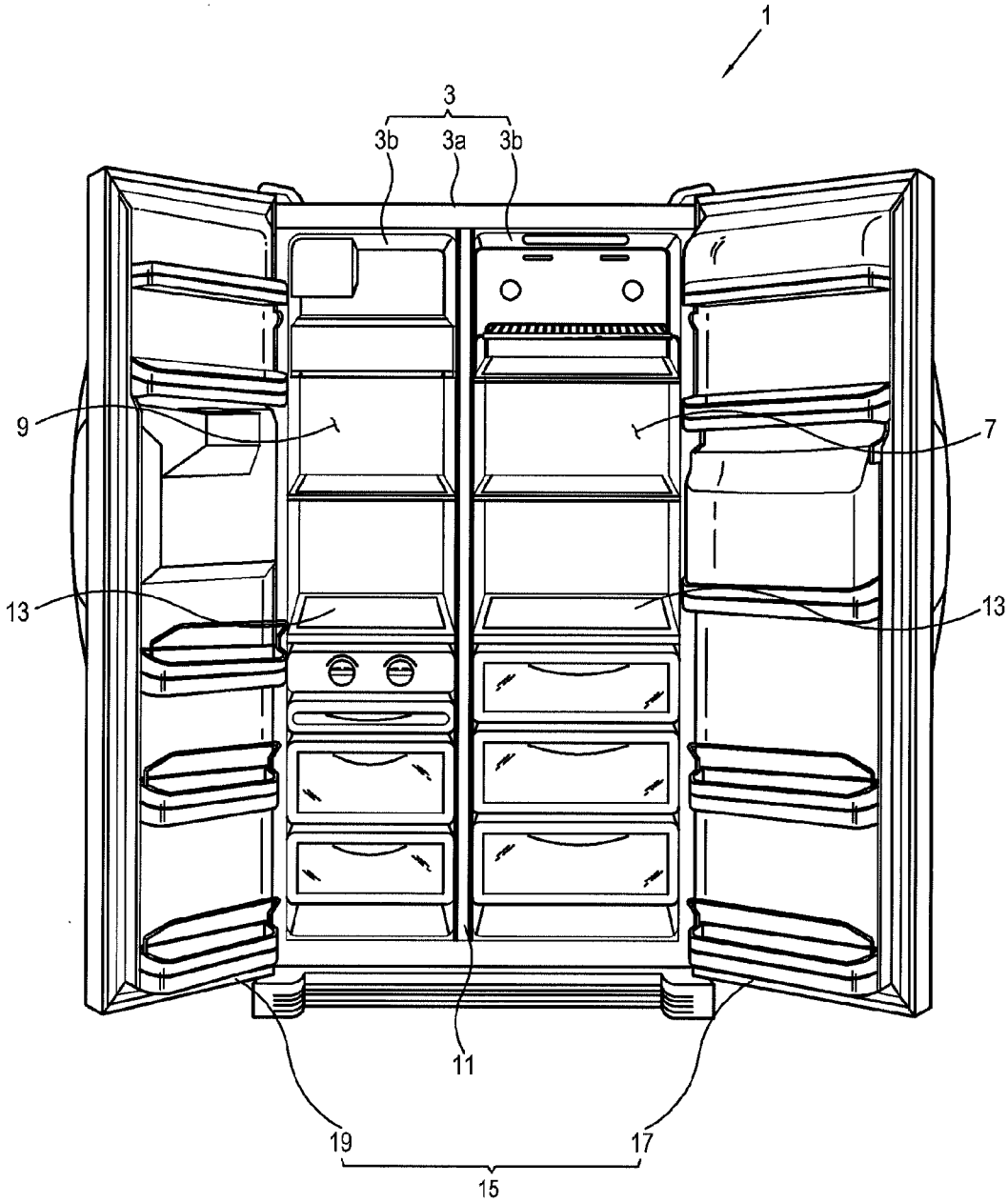
FIG. 1 is a perspective view illustrating a refrigerator according to an embodiment, doors of which are opened.
Figure 2:
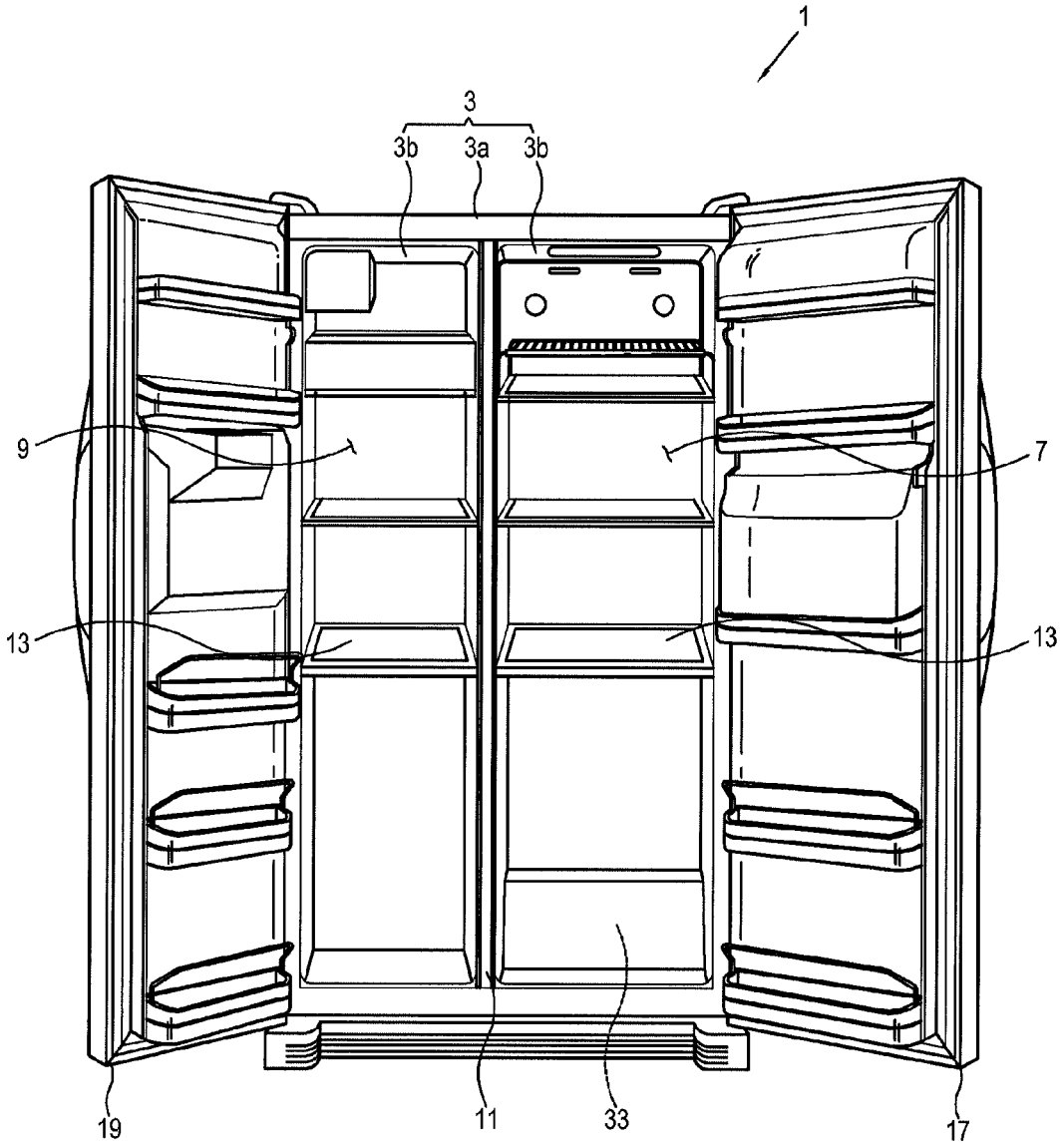
FIG. 2 is a perspective view illustrating storage spaces of a refrigerator compartment and a freezer compartment in a refrigerator according to an embodiment

Reference will now be made in detail to the embodiment, examples of which are illustrated in the accompanying drawings, wherein like reference numerals refer to like elements throughout. The embodiment is described below to explain the present invention by referring to the figures.

As shown in FIGS. 1 to 6, a refrigerator (1) according to an embodiment includes a main body cabinet 3 and a lower cabinet 61.

The main body cabinet 3 includes an external cabinet 3*a* forming an outer appearance, and an internal cabinet 3*b* placed inside the external cabinet 3*a* and forming first and second storage compartments.

The first and second storage compartments are divided at right and left sides by partition wall 11 of the internal cabinet 3*b*. Hereinafter, for convenience, the first storage compartment will be called a refrigerator compartment 7 to preserve and cool stored items, and the second storage compartment will be called a freezer compartment 9 to preserve and freeze stored items at a temperature of 0 degrees Celsius or lower.

Further, a plurality of shelves 13 are disposed within the refrigerator compartment 7 and the freezer compartment 9 and partition each of the refrigerator compartment 7 and the freezer compartment 9 into a plurality of spaces so that the stored items can be easily managed.

Also, a door 15 is coupled to the front of the main body cabinet 3 and opens/closes the refrigerator compartment 7 and the freezer compartment 9.

The door 15 includes a refrigerator compartment door 17 to open/close the refrigerator compartment 7, and a freezer compartment door 19 to open/close the freezer compartment 9. The refrigerator and freezer compartment doors 7 and 9 are hingedly coupled to opposite sides of the main body cabinet 3 to be opened at right and left sides, thereby opening/closing the refrigerator compartment 7 and the freezer compartment 9.

Meanwhile, a component compartment 33 is provided between the external cabinet 3*a* and the internal cabinet 3*b* of the main body cabinet 3 and accommodates a compressor 45 for compressing a refrigerant therein. Here, the component compartment 33 is placed under either of the first or second storage compartment separately partitioned by a partition wall 11

According to an exemplary embodiment, the component compartment 33 is provided under the refrigerator compartment 7. That is, the component compartment 33 is not provided under the freezer compartment 9, so that a storage space of the freezer compartment 9 can be increased. Here, the component compartment 33 is partitioned by a case 3C not to transfer heat of high temperature from the component compartment 33 to the internal cabinet 3*b*.

The back of the internal cabinet 3*b* forms a curved surface to smoothly circulate air introduced into the component compartment 33 and a ventilating channel 41. Specifically, the internal cabinet 3*b* forming the refrigerator compartment 7 is curved to protrude toward the front of the main body cabinet 3 so that the component compartment 33 can be formed between the internal cabinet 3*b* and the external cabinet 3*a*.

Further, the internal cabinet 3*b* forming the freezer compartment 9 is approximately perpendicular to a bottom of the main body cabinet 3 and recessed toward the back of the main body cabinet 3, thereby communicating with the component compartment 33 and forming the ventilating channel 41 guiding air in the component compartment 33 to be discharged to the outside.

The ventilating channel 41 is formed by the bottom 5 of the main body cabinet 3 and the partition 37*b* forming the free accommodating space 35*b* of the freezer compartment 9, and the ventilating channel 41 communicates with the component compartment 33, thereby guiding air in the component compartment 33 to be discharged to the outside. In this embodiment, the ventilating channel 41 is placed behind the lower part of the freezer compartment 9. Also, an electrical component case (not shown) to accommodate an electrical component, such as a defrosting timer, a starting condenser and a fuse, may be provided in the ventilating channel 41.

Further, the component compartment 33 is provided with a fan 47 to blow air in the component compartment 33 outward. The fan 47 faces the compressor 45 and is oblique to a longitudinal axis, or an air inlet portion, of the ventilating channel 41. Accordingly, air in the component compartment 33 is smoothly ventilated, thereby enhancing the cooling efficiency of the compressor 45 and a condenser 65 (to be described later).

The bottom 5 of the main body cabinet 3 is formed with a communicating hole 51 (shown in FIG. 6) through which air passing through a condenser 65 is introduced into the component compartment 33, and an air outlet 53 which communicates with the ventilating channel 41 and through which air flowing in the ventilating channel 41 is discharged to the outside. Here, the communicating hole 51 and the air outlet 53 are spaced apart from each other.

Meanwhile, a bottom cabinet 61 is coupled to a lower part of the main body cabinet 3 and accommodates the condenser 65 condensing the refrigerant supplied from the compressor 45.

The bottom cabinet 61 is shaped like a cabinet that is opened to opposite sides and a top side. The bottom cabinet 61 is disposed in a front part of the bottom of the main body cabinet 3 having the component compartment 33. That is, according to an exemplary embodiment, the bottom cabinet 61 is placed in the bottom of the refrigerator compartment 7, where the component compartment 33 is provided. The bottom cabinet 61 forms a predetermined space to accommodate the condenser 65. Further, one of the opposite sides of the bottom cabinet 61 toward the front of the main body cabinet 3 is opened to form an air inlet 63 through which external air is introduced toward the condenser 65. Also, the other of the opposite sides of the bottom cabinet 61 toward the back of the main body cabinet 3 is opened to communicate with the communicating hole 51 of the main body cabinet 3.

The bottom cabinet 61 is spaced apart from the air outlet 53 of the main body cabinet 3 so that air having a high temperature after cooling the component compartment 33 can be prevented from being reintroduced into the component compartment 33 through the air inlet 63 of the bottom cabinet 61. Here, the bottom cabinet 61 may be fastened to the main body cabinet 3 by a screw or any other known fastener.

The condenser 65 is provided as an in-line type to be accommodated in the bottom cabinet 61. Accordingly, a height of the bottom cabinet 61 protruding from the main body cabinet 3 toward a floor on which the refrigerator according to the present embodiment is installed can be reduced. Also, the condenser 65 is accommodated in the bottom cabinet 61 so that the volume of the component compartment 33 can be decreased, thereby increasing the capacity of the storage compartment.

Meanwhile, a rear cover 71 is provided to cover the back of the component compartment 33, thereby protecting the compressor 45 and the fan 47 which are accommodated in the component compartment 33.

With this configuration, if the compressor 45 is driven, the compressor 45 compresses a gaseous refrigerant to be a gaseous refrigerant having a high temperature and a high pressure. The gaseous refrigerant compressed by the compressor 45 is condensed into a liquid refrigerant through the condenser 65. The condensed liquid refrigerant is decompressed in a capillary tube (not shown), and then is evaporated in an evaporator (not shown) to cool an ambient air of the storage compartment.

In the component compartment 33 that accommodates the compressor 45 compressing the refrigerant into the gaseous refrigerant having the high temperature and pressure, and in the bottom cabinet 61 that accommodates the condenser 65 condensing the gaseous refrigerant, a high temperature is generated from the compressor 45 and the condenser 65, which deteriorates a cooling performance of the evaporator.

Figure 3:
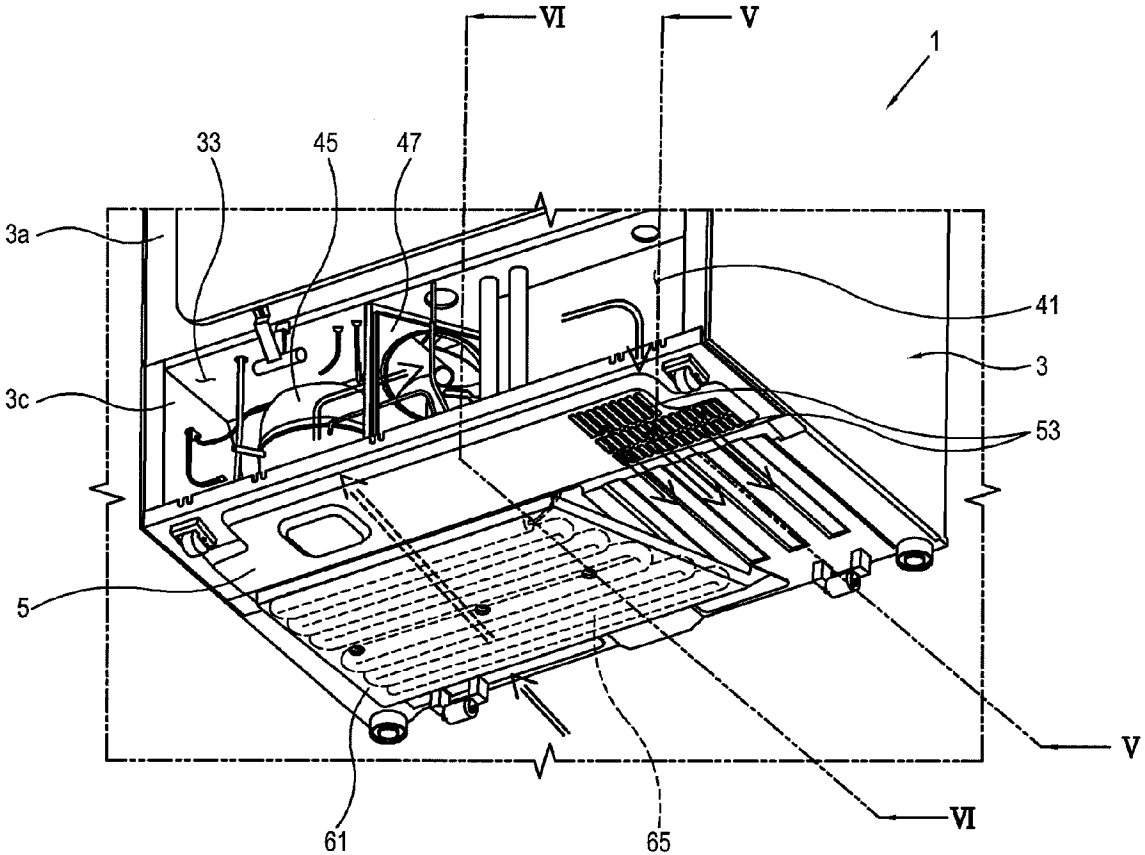
FIG. 3 is a bottom perspective view showing a part of a component compartment in FIG. 1.
Figure 4:
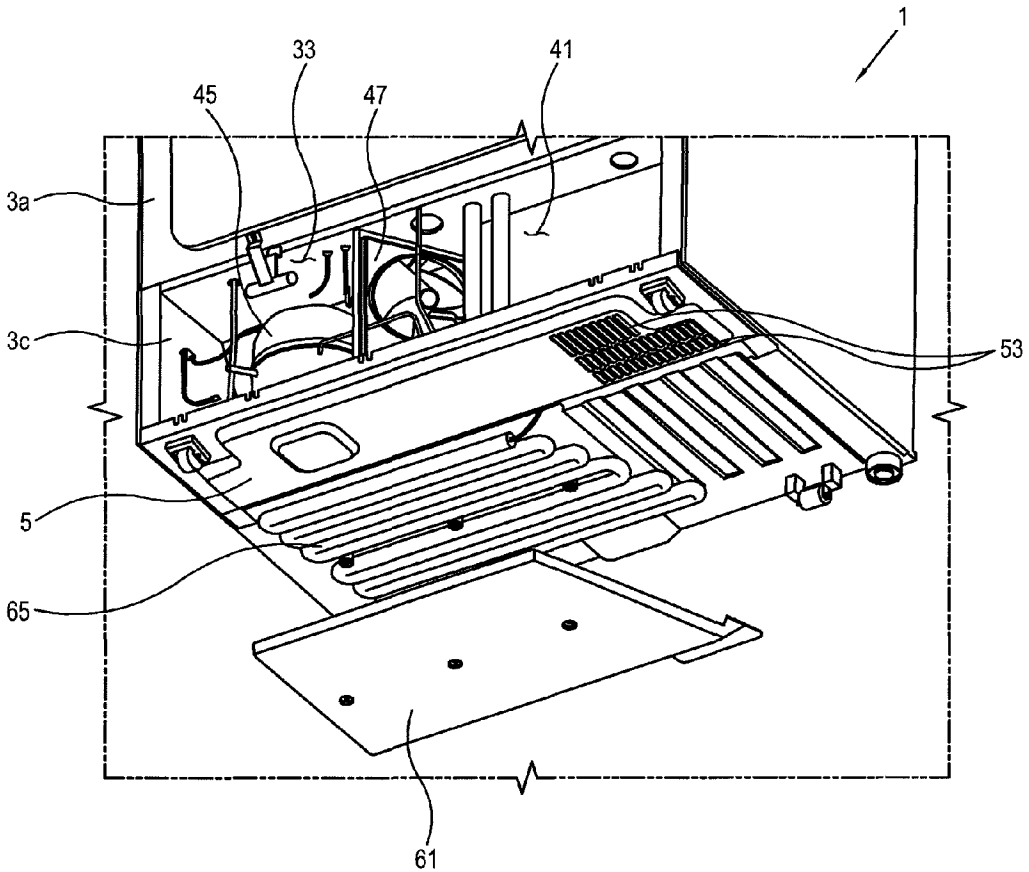
Figure 5:
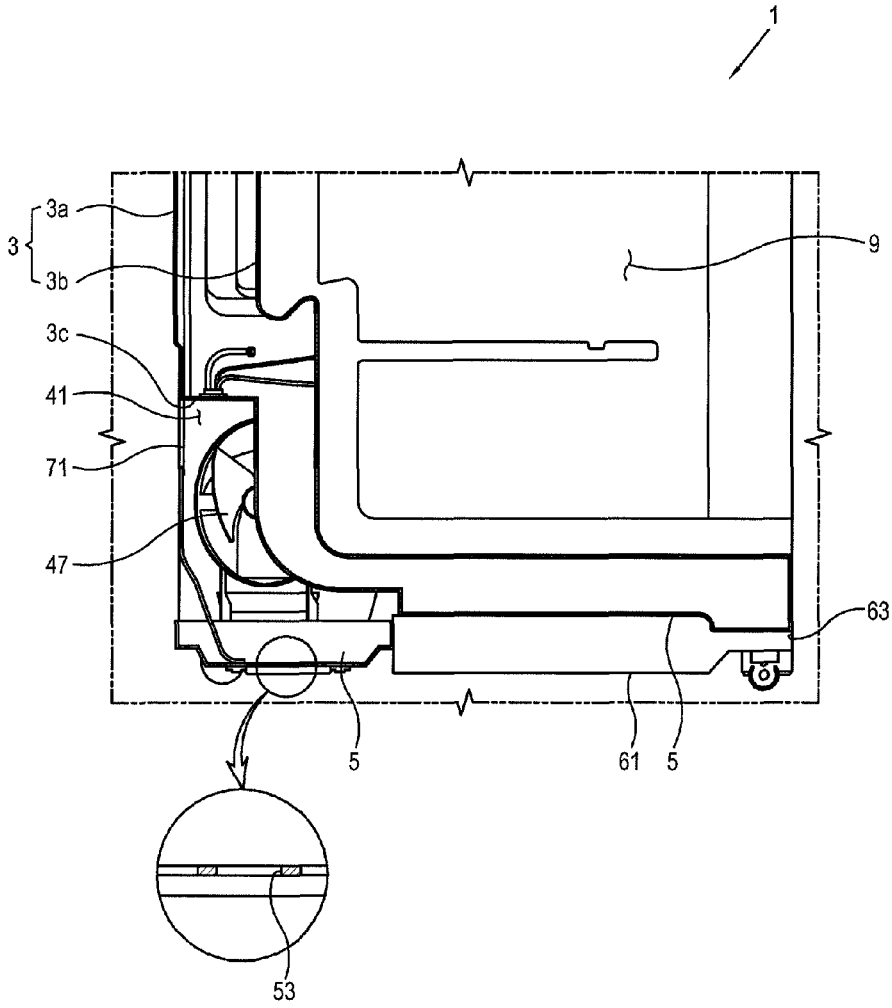
FIG. 5 is a sectional view of a part of the component compartment, taken along line V-V in FIG. 3.
Figure 6:
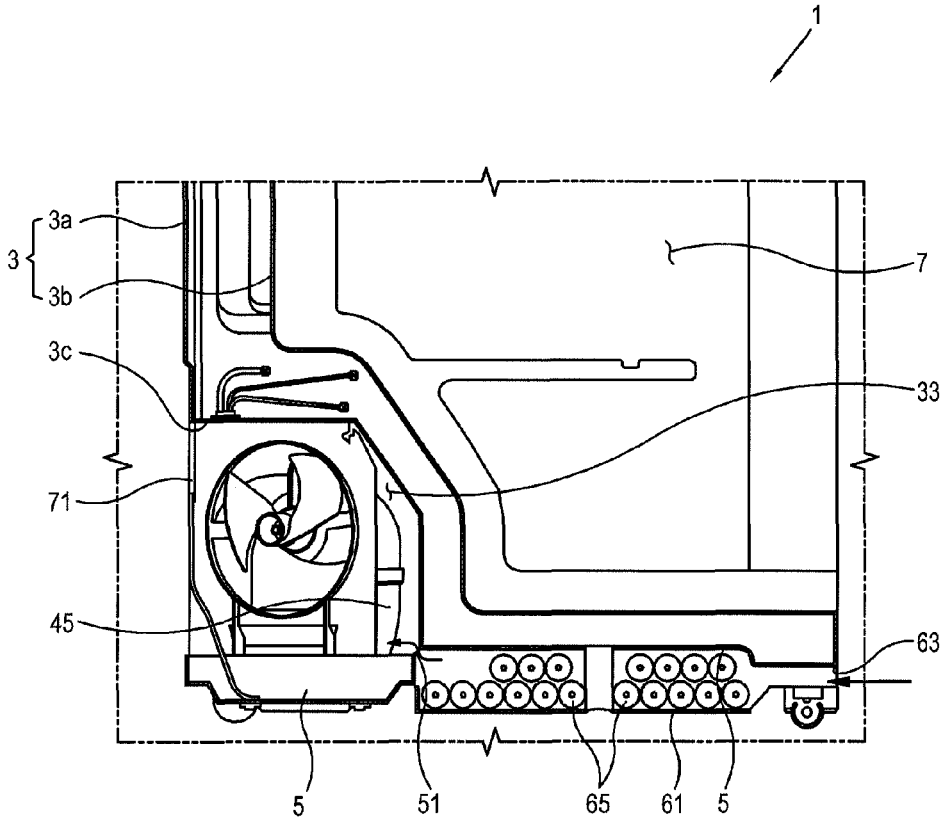
FIG. 6 is a sectional view a part of the component compartment, taken along line VI-VI in FIG. 3.
Figure 7:
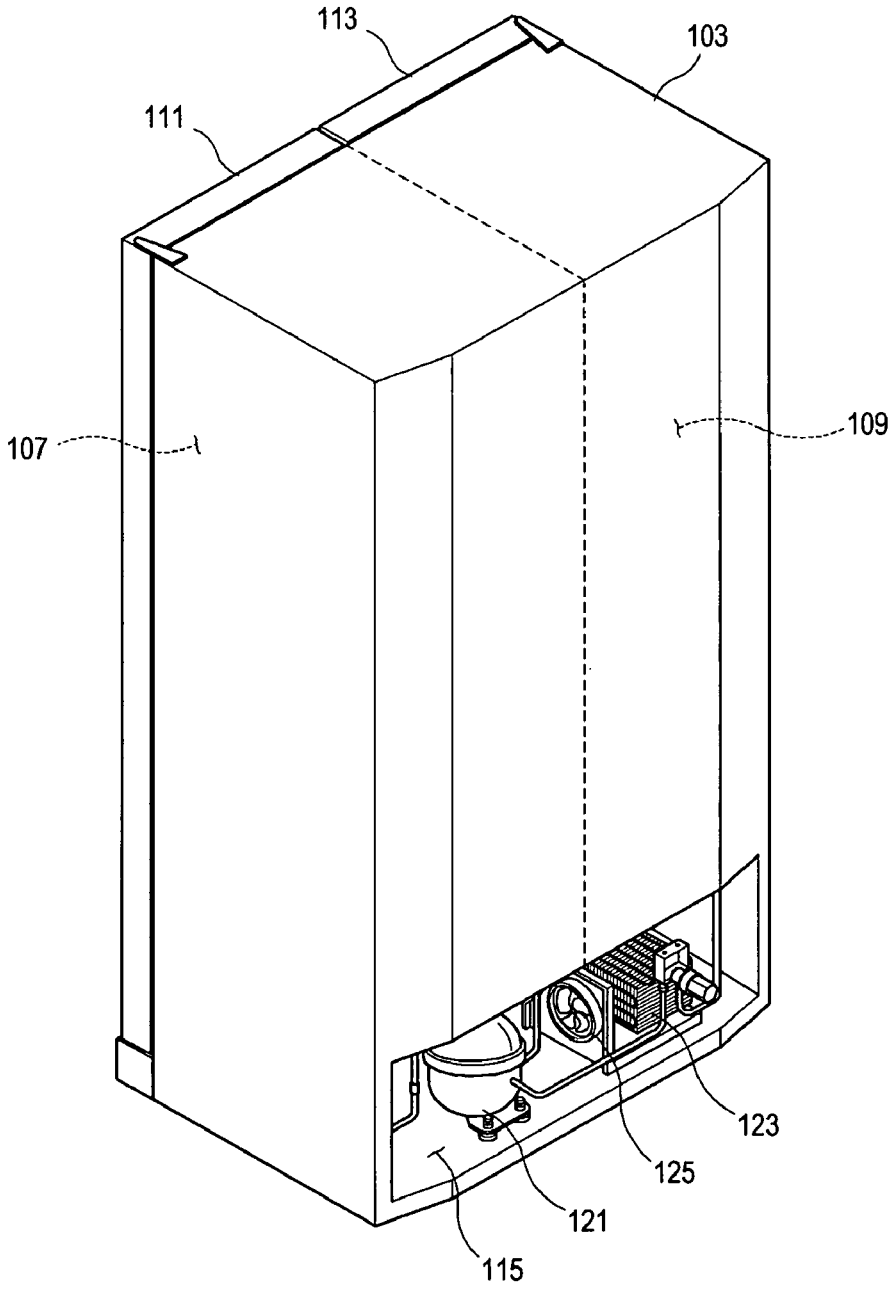
FIG. 7 (RELATED ART)
FIG. 7 is a rear perspective view of a conventional refrigerator.

Accordingly, as shown in FIGS. 3 and 6, the fan 47 is driven to introduce air from the outside near the front of the main body cabinet 3 into the bottom cabinet 61 through the air inlet 63, so that the air can cool the condenser 65 accommodated in the bottom cabinet 61 and then be introduced into the component compartment 33 through the communicating hole 51.

The air introduced into the component compartment 33 cools the compressor 45 and then moves along the ventilating channel 41 by the fan 47 to be discharged to the outside through the air outlet 53 of the main body cabinet 3.

According to an embodiment, the refrigerator includes the component compartment 33 which is placed in a lower rear part of the refrigerator compartment 7 and accommodates the compressor 45 to compress the refrigerant and the fan 47 to cool the compressor 45 therein. Accordingly, there is no need to extend the component compartment 33 to the lower part of the freezer compartment 9, so that a capacity of the freezer compartment 9 can increase to thereby efficiently use an inner space of the freezer compartment 9.

In the foregoing embodiment, the component compartment is formed in the lower rear part of the refrigerator compartment, and the ventilating channel is formed in the lower rear part of the freezer compartment, but the embodiment is not limited thereto. Alternatively, the component compartment may be formed in the lower rear part of the freezer compartment, and the ventilating channel may be formed in the lower rear part of the refrigerator compartment, for example. In this case, a capacity of the refrigerator compartment can increase to thereby efficiently use an inner space of the refrigerator compartment.

Further, in the aforementioned embodiment, the fan is installed in the component compartment, but the embodiment is not limited thereto. Alternatively, the fan may be installed in the ventilating channel, for example.

Further, in the above-described embodiment, the air inlet of the bottom cabinet is formed toward the front of the main body cabinet, but the embodiment is not limited thereto. Alternatively, the air inlet may be formed on a bottom surface of the bottom cabinet, for example.

As described above, the present embodiment provides a refrigerator of which a storage compartment increases in a capacity to thereby efficiently use an inner space thereof.

Although an embodiment has been shown and described, it will be appreciated by those skilled in the art that changes may be made in this embodiment without departing from the principles and spirit of the invention, the scope of which is defined in the appended claims and their equivalents.

What is claimed is:

1. A refrigerator comprising:

a main body cabinet which comprises an external cabinet, and an internal cabinet disposed inside the external cabinet and comprising a partition wall forming first and second storage compartments partitioned right and left, one of the first and second storage compartments being provided thereunder with a component compartment accommodating a compressor between the external cabinet and the internal cabinet but the other one being not provided thereunder with the component compartment; and a bottom cabinet which is coupled to a bottom of the main body cabinet and accommodates a condenser for condensing a refrigerant received from the compressor accommodated in the component compartment.

2. The refrigerator according to claim 1, wherein the condenser is provided as an in-line type along a surface of the bottom cabinet.

3. The refrigerator according to claim 2, wherein the bottom cabinet is formed with an air inlet through which external air is introduced to the condenser, and the main body cabinet is formed with a communicating hole at a bottom thereof, through which air passed by the condenser is introduced into the component compartment.

4. The refrigerator according to claim 1, further comprising a ventilating channel provided in the main body cabinet communicating with the component compartment and guiding air in the component compartment to be discharged outwardly.

5. The refrigerator according to claim 4, further comprising a fan provided in either of the component compartment or the ventilating channel and blowing air in the component compartment outwardly.

6. The refrigerator according to claim 5, wherein the fan faces the compressor and is oblique to a longitudinal axis of the ventilating channel.

7. The refrigerator according to claim 1, wherein the bottom cabinet is disposed under the component compartment.

8. A refrigerator comprising:

an external cabinet; and an internal cabinet disposed inside the external cabinet and comprising a partition wall forming first and second storage compartments partitioned right and left, one of the first and second storage compartments being provided thereunder with a component compartment accommodating a compressor between the external cabinet and the internal cabinet but the other one being not provided thereunder with the component compartment.

9. The refrigerator according to claim 8, further comprising a ventilating channel formed between a bottom of the refrigerator and one of the partitions and communicating with the component compartment to guide air from the component compartment to an outside of the refrigerator.

10. The refrigerator according to claim 8, further comprising a bottom cabinet disposed under the external cabinet with the component compartment therebetween, and accommodating a condenser for condensing a refrigerant received from the compressor accommodated in the component compartment.

11. The refrigerator according to claim 10, wherein the condenser is provided as an in-line type along a surface of the bottom cabinet.

12. The refrigerator according to claim 9, wherein the ventilating channel is formed by the bottom of the refrigerator.

* * * * *